US012655783B2

(12) United States Patent
Peitz et al.

(10) Patent No.: US 12,655,783 B2
(45) Date of Patent: Jun. 16, 2026

(54) EXHAUST GAS AFTERTREATMENT SYSTEM IN AN EXHAUST GAS SYSTEM OF AN AMMONIA COMBUSTION ENGINE, METHOD AND USE THEREOF

(71) Applicant: HUG Engineering AG, Elsau (CH)

(72) Inventors: Daniel Peitz, Elsau (CH); Adrian Marberger, Elsau (CH)

(73) Assignee: HUG ENGINEERING AG, Elsau (CH)

( * ) Notice: Subject to any disclaimer, the term of this patent is extended or adjusted under 35 U.S.C. 154(b) by 0 days.

(21) Appl. No.: 18/993,917

(22) PCT Filed: Jun. 14, 2023

(86) PCT No.: PCT/EP2023/065933
§ 371 (c)(1),
(2) Date: Jan. 13, 2025

(87) PCT Pub. No.: WO2024/012792
PCT Pub. Date: Jan. 18, 2024

(65) Prior Publication Data

US 2026/0015958 A1 Jan. 15, 2026

(30) Foreign Application Priority Data

Jul. 14, 2022 (DE) ..... 102022117569.3

(51) Int. Cl.
*F01N 3/20* (2006.01)

(52) U.S. Cl.
CPC ..... *F01N 3/2066* (2013.01); *F01N 2570/145* (2013.01); *F01N 2610/02* (2013.01)

(58) Field of Classification Search
CPC ..... F01N 3/2066; F01N 2570/145; F01N 2610/02
See application file for complete search history.

(56) References Cited

U.S. PATENT DOCUMENTS 8,423,265 B2 * 4/2013 Aso ..... F01N 5/02 123/304
10,301,990 B2 * 5/2019 De Smet ..... B60W 10/08
(Continued)

FOREIGN PATENT DOCUMENTS

| | | | |
|---|---|---|---|
| DE | 102020128786 | A1 | 5/2022 |
| EP | 3971083 | A1 | 3/2022 |
| WO | 2021257549 | A1 | 12/2021 |

OTHER PUBLICATIONS

Jun. 2022, Ebrahium Nahimi, Effects of using ammonia as a primary fuel on engine performance and emissions in an ammonia/biodiesel dual-fuel CI engine (Year: 2022).*

*Primary Examiner* — Jesse S Bogue
(74) *Attorney, Agent, or Firm* — McNees Wallace & Nurick LLC

(57) ABSTRACT

An exhaust gas aftertreatment system in the exhaust gas system of an ammonia combustion engine, wherein the exhaust gas system can be traversed by an exhaust gas flow of the ammonia combustion engine, including a passive SCR catalyst, an oxidation catalyst with which ammonia contained in the exhaust gas flow can be oxidized, and a regulated SCR catalyst. The oxidation catalyst is arranged in the exhaust gas system downstream of the passive SCR catalyst and the regulated SCR catalyst is arranged in the exhaust gas system downstream of the oxidation catalyst. The exhaust gas aftertreatment system further comprises at least one N2O decomposition catalyst arranged in the exhaust gas system upstream of the passive SCR catalyst or downstream of the passive SCR catalyst, the oxidation catalyst, and/or the regulated SCR catalyst.

9 Claims, 2 Drawing Sheets

(56) References Cited

U.S. PATENT DOCUMENTS

| | | | | |
|---|---|---|---|---|
| 10,480,373 | B2 * | 11/2019 | Haas | F01N 3/021 |
| 11,415,034 | B2 * | 8/2022 | Montgomery | F01N 13/0093 |
| 11,890,575 | B2 * | 2/2024 | Sung | B01J 29/68 |
| 11,927,124 | B2 * | 3/2024 | Sakuja | F01N 13/009 |
| 2011/0265455 | A1 | 11/2011 | Hirota et al. | |
| 2011/0283684 | A1 | 11/2011 | Aso et al. | |

* cited by examiner

EXHAUST GAS AFTERTREATMENT SYSTEM IN AN EXHAUST GAS SYSTEM OF AN AMMONIA COMBUSTION ENGINE, METHOD AND USE THEREOF

FIELD OF DISCLOSURE

The present disclosure relates to an exhaust gas aftertreatment system in an exhaust gas system of an ammonia combustion engine, a method for exhaust gas aftertreatment of an exhaust gas flow generated by an ammonia combustion engine, and the use of an $N_2O$ decomposition catalyst.

BACKGROUND

Ammonia combustion engines are internal combustion engines which use ammonia as fuel and represent an alternative to "classic" internal combustion engines that use hydrocarbons such as natural gas, gasoline, or diesel as fuel. The use of ammonia combustion engines is particularly desirable if hydrocarbons from fossil sources are replaced by so-called "green" ammonia as fuel.

In this context, the term "green ammonia" refers to ammonia produced on the basis of hydrogen produced by means of electrolysis, wherein the electrical energy necessary for the electrolysis was obtained via renewable energy sources such as wind or solar energy. As a result, the use of ammonia combustion engines makes it possible to reduce the emission of carbon dioxide and thus minimize greenhouse gas emissions.

However, ammonia combustion engines generate exhaust gas flows that are fundamentally different from those that occur in a classic internal combustion engine. In particular, it is important to prevent that merely another greenhouse gas having the same or higher greenhouse gas potential as carbon dioxide is emitted by ammonia combustion engines, instead of carbon dioxide.

It is therefore the object of the present disclosure to provide a possibility for the exhaust gas aftertreatment of exhaust gas flows generated in an ammonia combustion engine, which in particular at least reduces the emission of compounds having a greenhouse gas potential greater than that of carbon dioxide.

SUMMARY

In some embodiment embodiments, an exhaust gas aftertreatment system in the exhaust gas system of an ammonia combustion engine is shown, wherein an exhaust gas flow of the ammonia combustion engine can flow through the exhaust gas system. The exhaust gas aftertreatment system comprises a passive SCR catalyst, an oxidation catalyst with which ammonia contained in the exhaust gas flow can be oxidized, and a regulated SCR catalyst. The oxidation catalyst is arranged in the exhaust gas system downstream of the passive SCR catalyst and the regulated SCR catalyst is arranged in the exhaust gas system downstream of the oxidation catalyst. The exhaust gas aftertreatment system further comprises at least one $N_2O$ decomposition catalyst situated in the exhaust gas system upstream of the passive SCR catalyst or downstream of the passive SCR catalyst, the oxidation catalyst and/or the regulated SCR catalyst.

It has been recognized that dinitrogen monoxide, or nitrous oxide (also referred to as "laughing gas" or $N_2O$), is contained in relevant fractions in exhaust gas flows generated by ammonia combustion engines. However, dinitrogen monoxide has a greenhouse gas potential which, over a time horizon of 100 years, is more than 250 times the greenhouse gas potential of carbon dioxide so that the emission of dinitrogen monoxide should be, or has to be, avoided as far as possible.

For this reason, according to the present disclosure, in the exhaust gas aftertreatment system at least one $N_2O$ decomposition catalyst is used that at least partially chemically converts dinitrogen monoxide contained in the exhaust gas flow. In other words, the $N_2O$ decomposition catalyst is set up to at least partially oxidize or reduce dinitrogen monoxide contained in the exhaust gas flow.

The $N_2O$ decomposition catalyst is also arranged according to the present disclosure within the exhaust gas aftertreatment system in such a way that the exhaust gas flow, when flowing through the $N_2O$ decomposition catalyst, has a composition adapted to the $N_2O$ decomposition catalyst so that the $N_2O$ decomposition catalyst has an optimized conversion rate and selectivity.

Suitable $N_2O$ decomposition catalysts are, for example, selected from the zeolites, in particular iron-loaded zeolites, spinel compounds, hexaluminate compounds, perovskite compound, and rhodium-containing catalysts. Cordierite can be used as $N_2O$ decomposition catalyst support.

The term "SCR catalyst" refers to catalysts that are used for selective catalytic reduction of nitrogen oxides ($NO_x$).

The passive SCR catalyst is an unregulated SCR catalyst. This means that it operates without regulation on the basis of measurement data of a measuring probe, on the basis of which a reducing agent is added. Instead, the passive SCR catalyst reduces nitrogen oxides contained in the exhaust gas flow with ammonia also contained in the exhaust gas flow, i.e., with ammonia emissions that leave the ammonia combustion engine uncombusted.

The passive SCR catalyst serves in particular to lower the content of nitrogen oxides, as is to be expected at the beginning of the exhaust gas aftertreatment in the exhaust gas flow so that the functioning of components of the exhaust gas aftertreatment system arranged in the exhaust gas flow downstream of the passive SCR catalyst is not impaired by nitrogen oxides present in the exhaust gas flow.

In addition, the passive SCR catalyst is not dependent on measurement data of a measuring probe so that the passive SCR catalyst can be arranged at locations in the exhaust gas system in which the nitrogen oxide concentration in the exhaust gas flow is so high that a measurement cannot be carried out, or cannot be carried out with sufficiently precision.

Furthermore, the passive SCR catalyst can serve as a cost-effective scavenger of catalyst poisons potentially contained in the exhaust gas flow. Catalyst poisons are compounds that limit the functionality of a catalyst at least temporarily, in particular permanently, to such an extent that the catalyst can no longer fulfill its intended function. The catalyst poisons contained in the exhaust gas flow can have their origin in a lubricating oil and/or an ignition jet fuel of the ammonia combustion engine.

The oxidation catalyst arranged in the exhaust gas flow downstream of the passive SCR catalyst acts to remove ammonia contained in the exhaust gas flow. In ammonia combustion engines, ammonia slip is to be expected; that is, unconverted ammonia can enter the exhaust gas flow from a combustion chamber of the ammonia combustion engine. The oxidation catalyst is therefore provided in order to enable the function and the precise controlling of components of the exhaust gas aftertreatment system and to prevent or at least minimize unwanted ammonia emissions.

At the same time, the oxidation catalyst can serve to remove any further oxidizable gases such as hydrogen ($H_2$) and/or hydrocarbons that have not been burned or have been burned incompletely that may be contained in the exhaust gas flow. These components may occur in the exhaust gas flow as residues from so-called "pilot fuels."

According to example embodiments, the oxidation catalyst is arranged upstream of the regulated SCR catalyst in the exhaust gas flow. In this way, the controlling of the regulated SCR catalyst is prevented from being adversely affected by fluctuating ammonia concentrations in the exhaust gas flow, or this effect is at least reduced.

In contrast to the passive SCR catalyst, the regulated SCR catalyst is operated on the basis of measurement data of a measuring probe assigned to the regulated SCR catalyst for determining a nitrogen oxide concentration in the exhaust gas flow. In this way, a precise control of the nitrogen oxide concentration in the exhaust gas flow downstream of the regulated SCR catalyst is possible.

A metering unit for supplying ammonia to the exhaust gas flow can also be provided upstream of the regulated SCR catalyst, the at least one $N_2O$ decomposition catalyst being situated in the exhaust gas system upstream of the metering unit or in the exhaust gas system downstream of the metering unit.

The content of ammonia in the exhaust gas flow can be adjusted via the metering unit in order to control the catalytic conversion of the nitrogen oxides still present in the exhaust gas flow in the regulated SCR catalyst, which is arranged downstream of the metering unit.

In particular, the metering unit further comprises a mixing module for mixing the ammonia supplied by the metering unit into the exhaust gas flow and the other components of the exhaust gas flow. For example, the mixing module is a connecting pipe which fluidically connects the metering unit and the regulated SCR catalyst.

Thus, the exhaust gas aftertreatment system according to the present disclosure is characterized, in particular, in that the type and arrangement of the components of the exhaust system can be matched optimally to the components present in the exhaust gas flow, i.e., the chemical composition of the exhaust gas flow, at the location of the respective component in the exhaust gas flow.

It is also possible for the position of the $N_2O$ decomposition catalyst within the exhaust gas aftertreatment system to be realized in such a way that the components contained in the exhaust gas flow at the position of the $N_2O$ decomposition catalyst have an accelerating effect on the reaction carried out by the $N_2O$ decomposition catalyst. In this way, synergistic effects in the conversion of the undesired constituents of the exhaust gas flow result from the targeted arrangement of the components of the exhaust gas aftertreatment system.

In a variant, at least two components of the exhaust gas aftertreatment system that directly succeed one another in the exhaust gas flow are accommodated in a common functional module.

For example, the passive SCR catalyst and the $N_2O$ decomposition catalyst, the regulated SCR catalyst and the $N_2O$ decomposition catalyst, or the oxidation catalyst and the $N_2O$ decomposition catalyst form a common functional module.

In yet another variant, at least one of the components of the exhaust gas aftertreatment system is a combined catalyst which combines two or more functions of the catalysts contained in the exhaust gas aftertreatment system in one component.

For example, the combined catalyst may be a combined $N_2O$ decomposition catalyst/SCR catalyst that decomposes nitrogen oxides and nitrous oxide simultaneously, for example according to the reaction equation $N_2O+NO \rightarrow N_2+NO_2$, followed by a selective catalytic reduction of the resulting $NO_2$.

The combined catalyst can also be a combined $N_2O$ decomposition catalyst/oxidation catalyst that simultaneously decomposes ammonia and nitrous oxide, for example according to the reaction equation $$3\,N_2O + 2\,NH_3 \longrightarrow 4\,N_2 + 3\,H_2O.$$

It is also possible for multiple $N_2O$ decomposition catalysts to be used or present in the exhaust gas aftertreatment system. In this case, depending on the position of the $N_2O$ decomposition catalyst in the sequence of the components of the exhaust gas aftertreatment system, an $N_2O$ decomposition catalyst can be used that is optimally designed with regard to the expected composition of the exhaust gas flow at the location of the respective $N_2O$ decomposition catalyst in the exhaust gas system.

Before the treatment with the exhaust gas aftertreatment system, the exhaust gas flow can have a temperature in the range from 250 to 550° C. Accordingly, the sequence of components of the exhaust gas aftertreatment system according to the invention in the direction of flow of the exhaust gas flow is designed, in particular, so that an exhaust gas flow with an initial temperature in the range from 250 to 550° C. can be subjected to the envisaged reaction sequences in order to convert undesirable constituents in the exhaust gas flow, such as ammonia, nitrogen oxides and nitrous oxide, into environmentally compatible substances.

The exhaust gas aftertreatment system may comprise an exhaust gas turbocharger through which the exhaust gas discharged from a cylinder of the ammonia combustion engine, i.e., the exhaust gas flow, is passed. The exhaust gas turbocharger makes it possible to at least partially utilize the thermal energy contained in the exhaust gas flow. In this way, the temperature of the exhaust gas flow can additionally be influenced in a targeted manner so that components of the exhaust gas aftertreatment system used in the exhaust gas flow downstream or upstream of the exhaust gas turbocharger can be operated in an optimal temperature range.

The exhaust gas turbocharger can be used at any suitable position within the exhaust gas aftertreatment system. For example, the exhaust gas turbocharger can be located upstream or downstream of the passive SCR catalyst, downstream of the oxidation catalyst, downstream of the regulated SCR catalyst, or downstream of the $N_2O$ decomposition catalyst in the exhaust gas flow.

The exhaust gas turbocharger has the effect that the temperature of the exhaust gas flow is lowered. This means that the temperature of the exhaust gas flow downstream of the exhaust gas turbocharger is lower than the temperature of the exhaust gas flow upstream of the exhaust gas turbocharger. Accordingly, the exhaust gas turbocharger is arranged in particular within the exhaust gas aftertreatment system in such a way that components of the exhaust gas aftertreatment system which are to be operated at a higher temperature are arranged in the exhaust gas flow upstream of the exhaust gas turbocharger while components of the exhaust gas aftertreatment system that are to be operated at a lower temperature are arranged in the exhaust gas flow downstream of the exhaust gas turbocharger. This ensures that all components of the exhaust gas aftertreatment system can be operated in an optimal temperature range.

The exhaust gas turbocharger is in particular a single-stage turbocharger.

Furthermore, before the treatment with the exhaust gas aftertreatment system, the exhaust gas flow can comprise up to 10,000 ppm ammonia, in particular up to 8,000 ppm ammonia, for example up to 5,000 ppm ammonia, and up to 5,000 ppm nitrogen oxides.

All indications given in ppm ("parts per million") are to be understood as volume concentrations under process conditions.

In addition, the exhaust gas flow can comprise up to 500 ppm of dinitrogen monoxide before the treatment with the exhaust gas aftertreatment system.

Before the treatment with the exhaust gas aftertreatment system, the exhaust gas flow can comprise water in a proportion of 5 to 25 percent by volume, in particular 10 to 25 percent by volume, for example 10 to 20 percent by volume.

The exhaust gas flow has in particular a pressure of up to 5 bar.

The components of the exhaust gas flow that are found at a particular point in time during operation of the ammonia combustion engine can thus differ within wide ranges depending on the load situation. The sequence of the components of the exhaust gas aftertreatment system provided and coordinated with one another according to the present disclosure enables the most optimal possible exhaust gas aftertreatment even under these conditions.

In addition, the composition of the exhaust gas flow to be treated differs fundamentally from compositions that occur in exhaust gas flows of classic internal combustion engines and in technical processes in which dinitrogen monoxide can likewise occur as a by-product, for example the production of nitric acid.

It is also possible for the exhaust gas aftertreatment system to be set up to not use the $N_2O$ decomposition catalyst in a predetermined operating mode. The predetermined operating mode is determined in particular by the fact that the exhaust gas flow does not contain any nitrous oxide, or contains nitrous oxide only in a concentration which is below a previously defined operating mode threshold value.

The ammonia combustion engine has in particular a power of 560 KW or more. Ammonia combustion engines of this kind are suitable for marine applications, for example as a ship engine.

The object is further achieved according to the present disclosure by a method for the exhaust gas aftertreatment of an exhaust gas flow generated by an ammonia combustion engine in an exhaust gas aftertreatment system, wherein dinitrogen monoxide present in the exhaust gas flow is at least partially converted by means of an $N_2O$ decomposition catalyst.

The method according to the present disclosure makes it possible to reliably prevent dinitrogen monoxide from being released into the environment, or at least to minimize the amount of dinitrogen monoxide released into the environment, despite the portions of dinitrogen monoxide present in the exhaust gas of an ammonia combustion engine.

The exhaust gas aftertreatment system is in particular an exhaust gas aftertreatment system as described above. The features and properties of the exhaust gas aftertreatment system according to the present disclosure apply correspondingly to the method according to the present disclosure, and vice versa.

Furthermore, the object is achieved by the use of an $N_2O$ decomposition catalyst in an exhaust gas aftertreatment system of an ammonia combustion engine.

The exhaust gas aftertreatment system is in particular an exhaust gas aftertreatment system as described above. The features and properties of the exhaust gas aftertreatment system according to the present disclosure apply correspondingly to the use according to the invention, and vice versa.

BRIEF DESCRIPTION OF DRAWINGS

Further features and properties of the invention result from the following description of exemplary embodiments which are not to be understood in a limiting sense, and from the figures. In the figures.

DETAILED DESCRIPTION

Figure 1:
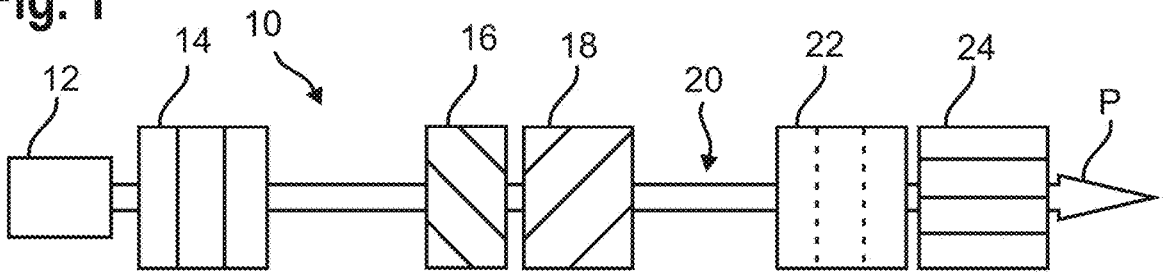
FIG. 1 shows a first embodiment of an exhaust gas aftertreatment system according to the invention of an ammonia combustion engine.

FIG. 1 schematically shows a first embodiment of an exhaust gas aftertreatment system 10 according to the present disclosure for an ammonia combustion engine 12.

The ammonia combustion engine 12 uses ammonia as fuel and converts it, generating an exhaust gas flow, which is indicated as arrow P in FIG. 1.

The ammonia combustion engine 12 is fluidly connected to the exhaust gas aftertreatment system 10, wherein the exhaust gas flow has a flow direction as shown by the arrow P in FIG. 1. In other words, components of the exhaust gas aftertreatment system 10 shown to the right of a respective reference point in FIG. 1 are located downstream of the respective reference point, and components of the exhaust gas aftertreatment system 10 shown in FIG. 1 to the left of a respective reference point are located upstream of the respective reference point.

The exhaust gas aftertreatment system 10 according to FIG. 1 comprises a passive SCR catalyst 14 along the flow direction of the exhaust gas flow, an oxidation catalyst 16, a metering unit 18 for supplying ammonia to the exhaust gas flow, a mixing module 20, a regulated SCR catalyst 22, and an $N_2O$ decomposition catalyst 24, which are each connected to one another in terms of flow and each form a component of the exhaust gas aftertreatment system 10.

The exhaust gas aftertreatment system 10 is used to clean the exhaust gas produced by the ammonia combustion engine 12 by chemically converting unwanted components of the exhaust gas flow.

The aim is to achieve as complete a conversion as possible of nitrogen oxides ($NO_x$), ammonia ($NH_3$), and dinitrogen monoxide ($N_2O$) contained in the exhaust gas flow into nitrogen ($N_2$), oxygen ($O_2$), and water ($H_2O$). This is made possible by the coordinated sequence according to the invention of the components of the exhaust gas aftertreatment system 10, described in more detail below.

Before the treatment with the exhaust gas aftertreatment system, the exhaust gas flow comprises in particular up to 10,000 ppm ammonia, up to 5,000 ppm nitrogen oxides, up to 500 ppm of dinitrogen monoxide, and water in a proportion of 5 to 25 percent by volume. It will be understood that the exact composition of the exhaust gas flow is dependent on the ammonia combustion engine 12 used and on the currently prevailing load state.

Figure 6:
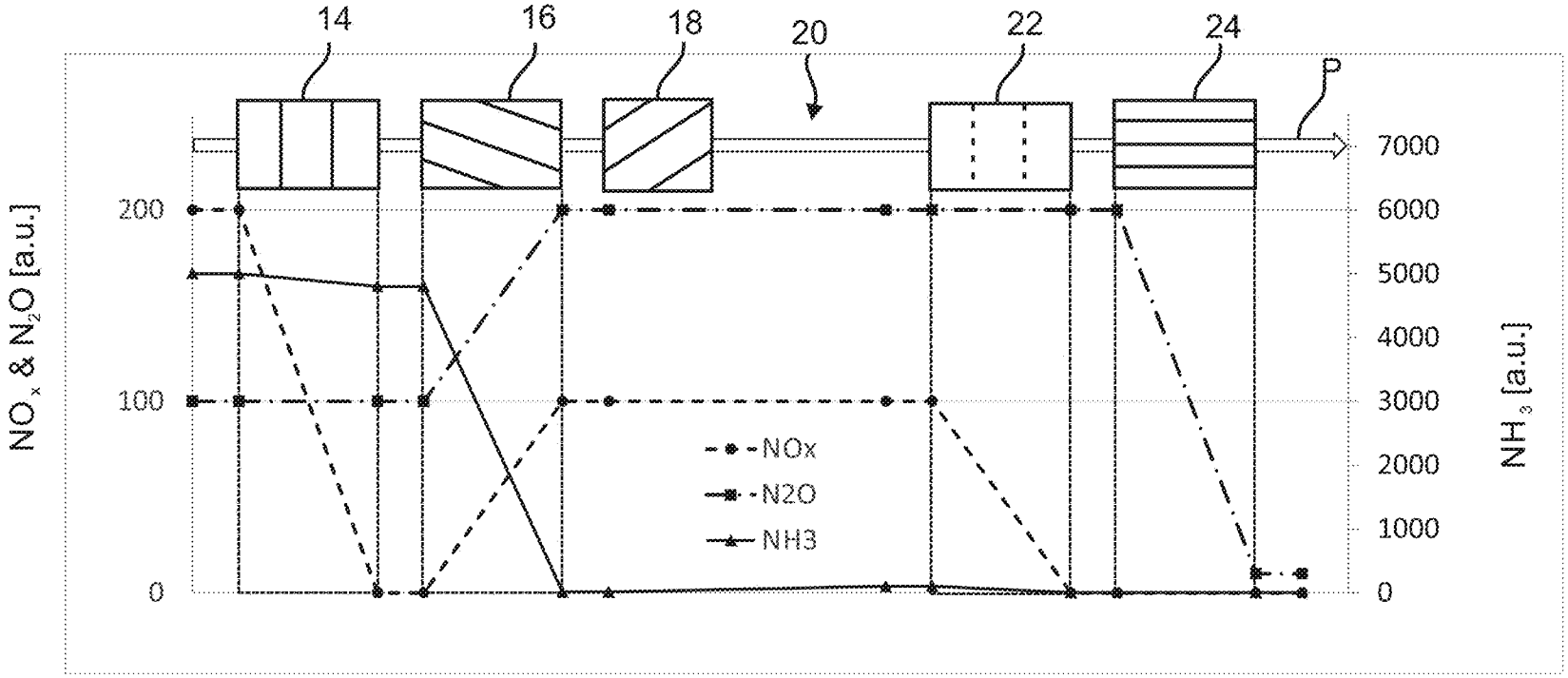
FIG. 6 shows a schematic flow diagram of the composition of an exhaust gas flow flowing through the exhaust gas aftertreatment system according to FIG. 1.

FIG. 6 shows a schematic flow diagram of the contents of selected constituents of the exhaust gas flow, namely nitrogen oxides ($NO_x$), dinitrogen monoxide ($N_2O$), and ammonia ($NH_3$), the concentration of which is to be as low as possible at the end of the exhaust gas aftertreatment system 10 situated downstream in the exhaust gas flow, i.e., after the exhaust gas flow has flowed through the components of the exhaust gas aftertreatment system 10.

In FIG. 6, only the relative contents of the respective constituent of the exhaust gas flow are plotted in order to illustrate the function of the various catalysts of the exhaust gas aftertreatment system 10. It will be understood that different ratios of the different components in the exhaust gas flow can also be present, depending on the design and load situation of the ammonia combustion engine 12.

First, the exhaust gas flow meets the passive SCR catalyst 14, which removes nitrogen oxides from the exhaust gas flow, the ammonia present in the exhaust gas flow being partially consumed for the chemical conversion of the nitrogen oxides. However, the passive SCR catalyst 14 is inert, or tolerant, to dinitrogen monoxide.

As can be seen in FIG. 6, the passive SCR catalyst 14 can be designed such that the exhaust gas flow downstream of the passive SCR catalyst 14 is substantially free of nitrogen oxides while the content of dinitrogen monoxide remains substantially unchanged and the content of ammonia is only slightly decreased compared to the composition of the exhaust gas flow upstream of the passive SCR catalyst 14.

This ensures that the components of the exhaust gas aftertreatment system 10 arranged in the exhaust gas flow downstream of the passive SCR catalytic converter 14 are not adversely affected by excessively high nitrogen oxide concentrations present in the exhaust gas flow. In particular, it can be ensured that the concentration of nitrogen oxides in the exhaust gas flow downstream of the passive SCR catalyst 14 is substantially independent of the concentration of nitrogen oxides in the exhaust gas flow upstream of the passive SCR catalyst 14.

The oxidation catalyst 16 is arranged in the exhaust gas flow downstream of the passive SCR catalyst 14 in the exhaust gas flow. The oxidation catalyst 16 selectively oxidizes ammonia present in the exhaust gas flow so that downstream of the oxidation catalyst 16 the exhaust gas flow is substantially free of ammonia.

Depending on the achievable selectivity of such an oxidation catalyst, nitrogen oxides and dinitrogen monoxide can also be produced as undesired by-products of the ammonia oxidation, as shown by the increasing contents in FIG. 6.

The oxidation catalyst 16 is preferably operated passively, i.e., without regulation on the basis of a measuring probe assigned to the oxidation catalyst 16.

In order to remove the newly formed quantity of nitrogen oxides, which however will typically be lower than the concentration of nitrogen oxides in the exhaust gas flow before the treatment with the exhaust gas aftertreatment system 10, a regulated SCR catalyst 22 is provided in the exhaust gas flow downstream of the oxidation catalyst 16.

The operation of the regulated SCR catalyst 22 is controlled via a measurement sensor (not shown) which measures the concentration of nitrogen oxides in the exhaust gas flow.

For the regulated operation of the regulated SCR catalyst 22, ammonia is supplied downstream of the oxidation catalyst 16 and upstream of the regulated SCR catalyst 22 by means of the metering unit 18, which ammonia is distributed in the exhaust gas flow while flowing through the mixing module 20, which is designed for example as a connecting pipe.

The comparatively small quantity of ammonia metered in a targeted fashion in this way via the metering unit 18 is in turn decomposed in the regulated SCR catalyst 22.

As is clear from the illustration in FIG. 6, no decomposition of dinitrogen monoxide in the exhaust gas flow takes place via the passive SCR catalyst 14, the oxidation catalyst 16, or the regulated SCR catalyst 22.

Therefore, according to the present disclosure, at least one $N_2O$ decomposition catalyst 24 is additionally provided that oxidizes or reduces dinitrogen monoxide contained in the exhaust gas flow. In this way, the content of dinitrogen monoxide can be lowered and minimized compared to the composition of the exhaust gas flow before the treatment with the exhaust gas aftertreatment system 10 according to the present disclosure.

In the first embodiment, the $N_2O$ decomposition catalyst 24 is situated in the exhaust gas flow downstream of the passive SCR catalyst 14, the oxidation catalyst 16, and the regulated SCR catalyst 22. In this way, an $N_2O$ decomposition catalyst can be used that is incompatible with nitrogen oxides and ammonia.

In return, all components situated in the exhaust gas flow upstream of the $N_2O$ decomposition catalyst 24 are preferably tolerant to dinitrogen monoxide.

In this context, the expression "incompatible with" a constituent of the exhaust gas flow means that the desired chemical conversion carried out by the respective component cannot take place, or at least can take place only with reduced yield and/or selectivity, if the corresponding constituents of the exhaust gas flow are present in a concentration that is above a threshold value, for example in a concentration of more than 10 ppm.

In contrast, the expression "tolerant to" a component of the exhaust gas flow is used to mean that the desired chemical conversion carried out by the respective component can proceed substantially unchanged even if the corresponding component of the exhaust gas flow is present, or is present in a concentration which is above a second threshold value, for example in a concentration of more than 100 ppm.

Optionally, the exhaust gas aftertreatment system 10 can have an exhaust gas turbocharger (not shown) which is arranged in the exhaust gas flow upstream of the passive SCR catalyst 14 or between any two of the previously described components of the exhaust gas aftertreatment system 10. In this case, the position of the exhaust gas turbocharger is selected such that optimal operating conditions are set for the components of the exhaust gas aftertreatment system 10 that are used.

Figure 2:
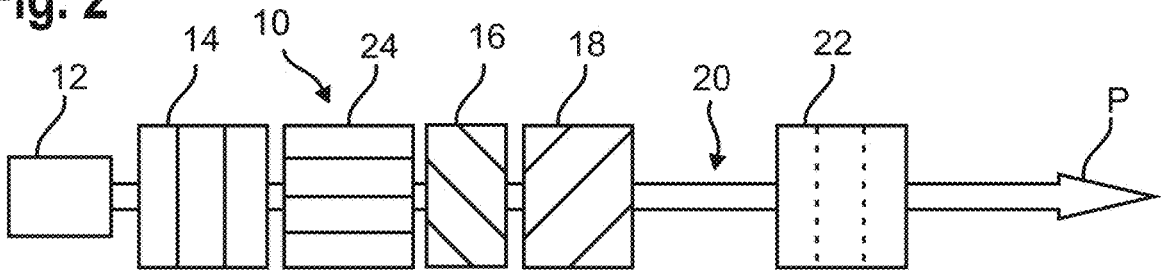
FIG. 2 shows a second embodiment of the exhaust gas aftertreatment system according to the invention from FIG. 1.

FIG. 2 shows a second embodiment of the exhaust gas aftertreatment system 10 according to the present disclosure.

The second embodiment substantially corresponds to the first embodiment so that only differences will be discussed below. Identical reference signs denote identical or functionally identical components, and reference is made to the above statements.

In the second embodiment, the $N_2O$ decomposition catalyst 24 is arranged in the exhaust gas flow downstream of the passive SCR catalyst 14 and upstream of the oxidation catalyst 16.

Accordingly, in this embodiment the passive SCR catalyst 14 is tolerant to dinitrogen monoxide and the $N_2O$ decomposition catalyst 24 is tolerant to ammonia, since the ammonia is first decomposed in the oxidation catalyst 16. It is also possible for the $N_2O$ decomposition catalyst 24 to be designed such that the amount of ammonia and/or nitrogen oxides still contained in the exhaust gas flow supports the function of the $N_2O$ decomposition catalyst 24.

In turn, the oxidation catalyst 16 and the regulated SCR catalyst 22 are not tolerant to dinitrogen monoxide, or the threshold value of these components with respect to dinitrogen monoxide can be selected lower, because the content of dinitrogen monoxide in the exhaust gas flow has already been at least lowered by the $N_2O$ decomposition catalyst 24 before the exhaust gas flow reaches the oxidation catalyst 16.

Optionally, a further $N_2O$ decomposition catalyst 24 can be arranged in the exhaust gas flow downstream of the regulated SCR catalyst 22, analogously to the first embodiment, which further catalyst decomposes residual contents of dinitrogen monoxide, or dinitrogen monoxide produced in the oxidation catalyst 16.

In principle, the passive SCR catalyst 14 and the $N_2O$ decomposition catalyst 24 may also be present in the form of a combined catalyst which not only converts nitrogen oxides with excess ammonia in the exhaust gas flow as described above, but at the same time at least partially converts the dinitrogen monoxide contained in the exhaust gas flow.

Figure 3:
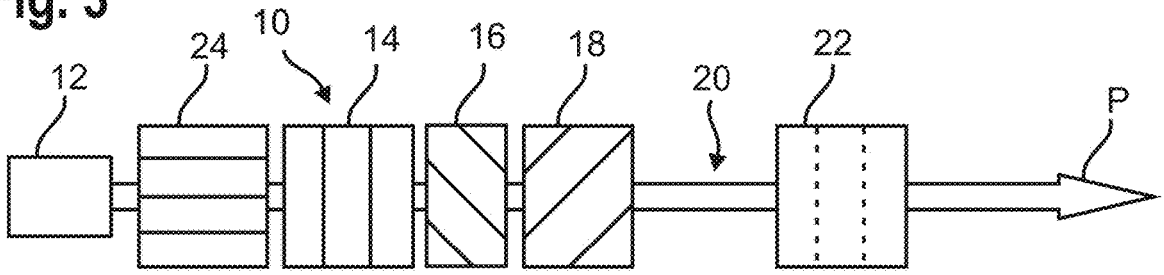
FIG. 3 shows a third embodiment of the exhaust gas aftertreatment system according to the invention from FIG. 1.

FIG. 3 shows a third embodiment of the exhaust gas aftertreatment system 10 according to the present disclosure.

The third embodiment substantially corresponds to the previous embodiments so that only differences will be discussed below. Identical reference signs denote identical or functionally identical components, and reference is made to the above statements.

In the third embodiment, the $N_2O$ decomposition catalyst 24 is arranged in the exhaust gas flow upstream of the passive SCR catalyst 14.

Thus, in the third embodiment the $N_2O$ decomposition catalyst 24 is the first component of the exhaust gas aftertreatment system 10 that is exposed to the exhaust gas flow produced by the ammonia combustion engine 12.

Therefore, in this case, the $N_2O$ composition catalyst 24 is designed to be tolerant to all components of the exhaust gas flow that are expected to be present due to the use of the ammonia combustion engine 12, and in particular tolerant to nitrogen oxides and ammonia.

In return, both the passive SCR catalyst 14, the oxidation catalyst 16, and also the regulated SCR catalyst 22 may be incompatible with dinitrogen monoxide, or at least their threshold value can be lowered with respect to dinitrogen monoxide.

Figure 4:
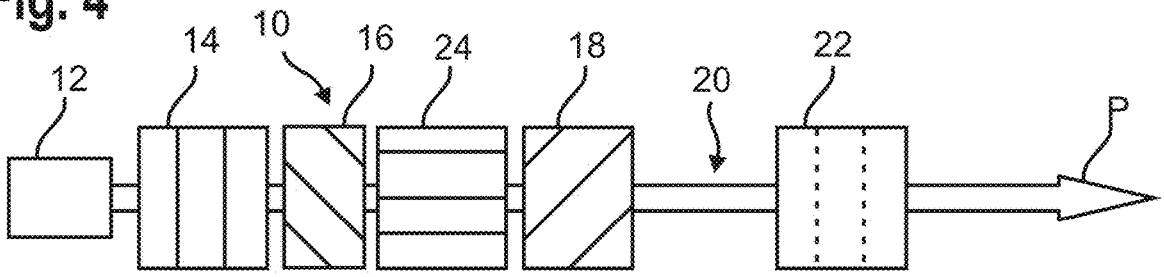
FIG. 4 shows a fourth embodiment of the exhaust gas aftertreatment system according to the invention from FIG. 1.

FIG. 4 shows a fourth embodiment of the exhaust gas aftertreatment system 10 according to the present disclosure.

The fourth embodiment substantially corresponds to the previous embodiments so that only differences will be discussed below. Identical reference signs denote identical or functionally identical components, and reference is made to the above statements.

In the fourth embodiment, the $N_2O$ decomposition catalyst 24 is arranged in the exhaust gas flow downstream of the passive SCR catalyst 14 and the oxidation catalyst 16 and upstream of the metering unit 18 and thus of the regulated SCR catalyst 22.

In this embodiment, the $N_2O$ decomposition catalyst 24 does not have to be designed to be tolerant to ammonia, and can either be designed not tolerant to nitrogen oxides or at least to have a lower threshold value with regard to nitrogen oxides than in the third embodiment.

In addition, the regulated SCR catalyst 22 can be incompatible with dinitrogen monoxide, or at least its threshold value with regard to dinitrogen monoxide can be lowered.

On the other hand, in this embodiment both the passive SCR catalyst 14 and the oxidation catalyst 16 are tolerant to dinitrogen monoxide.

Figure 5:
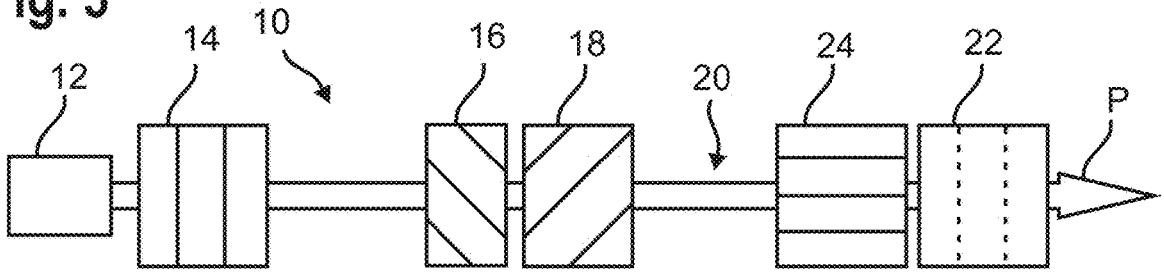
FIG. 5 shows a fifth embodiment of the exhaust gas aftertreatment system according to the invention from FIG. 1.

FIG. 5 shows a fifth embodiment of the exhaust gas aftertreatment system 10 according to the invention.

The fifth embodiment substantially corresponds to the previous embodiments, so that only differences will be discussed below. Identical reference signs denote identical or functionally identical components, and reference is made to the above statements.

In the fifth embodiment, the $N_2O$ decomposition catalyst 24 is arranged in the exhaust gas flow downstream of the passive SCR catalyst 14, the oxidation catalyst 16, and the metering unit 18, and upstream of the regulated SCR catalyst 22.

In this embodiment, the necessary design of the components that are used of the exhaust gas aftertreatment system 10 corresponds approximately to that of the fourth embodiment. However, the $N_2O$ decomposition catalyst 24 is at least tolerant to ammonia in the sense that the amounts of ammonia in the exhaust gas flow required for the operation of the regulated SCR catalyst 22 must not be above the threshold value of the $N_2O$ decomposition catalyst 24.

An arrangement of multiple $N_2O$ decomposition catalysts 24 at different positions within the exhaust gas flow is likewise within the meaning of the invention. The previously described embodiments can thus optionally be combined with one another.

Overall, the exhaust gas aftertreatment system 10 according to the invention is characterized in that the sequence of the components of the exhaust gas aftertreatment system 10 is coordinated with the components that are to be expected in the exhaust gas flow of an ammonia combustion engine and the proportions thereof, and at the same time with regard to the compatibility with these components.

While the disclosure has been described with reference to a preferred embodiment, it will be understood by those skilled in the art that various changes may be made and equivalents may be substituted for elements thereof without departing from the scope of the disclosure. In addition, many modifications may be made to adapt a particular situation or material to the teachings of the disclosure without departing from the essential scope thereof. While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

The invention claimed is:

1. An exhaust gas aftertreatment system in an exhaust gas system of an ammonia combustion engine, the exhaust gas system can be traversed by an exhaust gas flow of the ammonia internal combustion engine, comprising:

a passive SCR catalyst, an oxidation catalyst with which ammonia contained in the exhaust gas flow can be oxidized, and a regulated SCR catalyst, wherein the oxidation catalyst is arranged in the exhaust gas system downstream of the passive SCR catalyst, and the regulated SCR catalyst is arranged in the exhaust gas system downstream of the oxidation catalyst, wherein the exhaust gas aftertreatment system further comprises at least one $N_2O$ decomposition catalyst that is arranged in the exhaust gas system upstream of the passive SCR catalyst or downstream of at least one of the passive SCR catalyst, the oxidation catalyst, or the regulated SCR catalyst, and wherein, prior to the treatment with the exhaust gas aftertreatment system, the exhaust gas flow comprises water in a proportion of 5 to 25 percent by volume.

2. The exhaust gas aftertreatment system according to claim 1, further comprising a metering unit for supplying ammonia to the exhaust gas flow upstream of the regulated SCR catalyst and wherein the at least one $N_2O$ decomposition catalyst is arranged in the exhaust gas system upstream of the metering unit or in the exhaust gas system downstream of the metering unit.

3. The exhaust gas aftertreatment system according to claim 1, wherein one of the components of the exhaust gas aftertreatment system is a combined catalyst which combines in one component two or more functions of the catalysts contained in the exhaust gas aftertreatment system.

4. The exhaust gas aftertreatment system according to claim 1, wherein, prior to the treatment with the exhaust gas aftertreatment system, the exhaust gas flow has a temperature in the range of 250 to 550° C.

5. The exhaust gas aftertreatment system according to claim 1, wherein, prior to the treatment with the exhaust gas aftertreatment system, the exhaust gas flow comprises up to 10,000 ppm ammonia and up to 5,000 ppm nitrogen oxides.

6. The exhaust gas aftertreatment system according to claim 1, wherein, prior to the treatment with the exhaust gas aftertreatment system the exhaust gas flow comprises up to 500 ppm dinitrogen monoxide.

7. The exhaust gas aftertreatment system according to claim 1, wherein the ammonia combustion engine has a power of 560 kW or more.

8. A method for the exhaust gas aftertreatment of an exhaust gas flow produced by an ammonia combustion engine in an exhaust gas aftertreatment system of claim 1, wherein a dinitrogen monoxide present in the exhaust gas flow is at least partially converted by the at least one $N_2O$ decomposition catalyst.

9. A method of using an $N_2O$ decomposition catalyst in an exhaust gas aftertreatment system of an ammonia combustion engine of claim 1 to at least partially convert dinitrogen monoxide in an exhaust gas flow produced by the ammonia combustion engine.

* * * * *